US009328458B2

(12) United States Patent
Saetheråsen

(10) Patent No.: US 9,328,458 B2
(45) Date of Patent: May 3, 2016

(54) DIGESTER SHELL EXTENSION

(71) Applicant: Valmet AB, Sundsvall (SE)

(72) Inventor: Jonas Saetheråsen, Hammarö (SE)

(73) Assignee: Valmet AB, Sundsvall (SE)

( * ) Notice: Subject to any disclaimer, the term of this patent is extended or adjusted under 35 U.S.C. 154(b) by 0 days.

(21) Appl. No.: 14/717,707

(22) Filed: May 20, 2015

(65) Prior Publication Data

US 2015/0337491 A1 Nov. 26, 2015

(30) Foreign Application Priority Data

May 23, 2014 (SE) ..... 1450621

(51) Int. Cl.
*D21C 7/00* (2006.01)
*D21C 3/24* (2006.01)
*D21C 7/08* (2006.01)

(52) U.S. Cl.
CPC .. *D21C 7/00* (2013.01); *D21C 3/24* (2013.01); *D21C 7/08* (2013.01)

(58) Field of Classification Search
CPC ..... D21C 7/00; D21C 3/24; D21C 7/08
USPC ..... 162/237
See application file for complete search history.

(56) References Cited

U.S. PATENT DOCUMENTS

| | | | |
|---|---|---|---|
| 6,280,575 | B1 | 8/2001 | Prough |
| 2007/0056707 | A1 | 3/2007 | Snekkenes |

FOREIGN PATENT DOCUMENTS

| | | |
|---|---|---|
| JP | S54156801 | 12/1979 |
| SE | 526275 | 12/2003 |

*Primary Examiner* — Mark Halpern
(74) *Attorney, Agent, or Firm* — Rolf Fasth; Fasth Law Offices

(57) ABSTRACT

The invention relates to an improved design of the bottom of a continuous digester reducing the torque load on conventional bottom scrapers with scraper arms arranged at an angle α in relation to the horizontal plane in the range between 5°-30°. A simple digester shell extension VE is installed below the lowermost wash screen WS, ending at a small distance D above the end of the outer end of the scraper arm. The shell extension prevents the descending pulp column from expanding below the wash screen and enables easier shaving action from the scraper, using a dilution and expansion volume established at the outer ends of the scraper arms.

9 Claims, 5 Drawing Sheets

DIGESTER SHELL EXTENSION

PRIOR APPLICATION

This is a US patent application that claims priority from Swedish patent application number SE 1450621-6, filed 23 May 2014.

TECHNICAL AREA

The present invention relates to an improved design of the bottom of continuous digesters.

BACKGROUND AND SUMMARY OF THE INVENTION

Several solutions have been proposed to improve the discharge of delignified pulp from continuous digesters. The largest digesters have a total height of about 100 meters and with a bottom diameter well over 8 meter, in some digesters over 12 meter. The digester is typically pressurized to at least 3-6 bar, and in older digesters to about 8-10 bar. When using the conventional discharge scraper in the bottom of the digester, typically a motor with at least a 600-800 HP rating is needed.

Even with these huge motors could the operating conditions be exceeded such that overload protection is activated at frequent intervals. These huge motors also contributes in excessive operating costs as well as a risk for reduced pulp strength due to extensive mechanical agitation on the delignified pulp.

The bottom scraper is needed to maintain a plug-flow of chips down the digester and equal retention time in the digester for chips passing the wall of the digester as well as for chips passing down in the center of the chip column inside the digester, obtaining an even pulp quality in the pulp fed out from the digester.

FIG. 1 discloses a conventional design of the bottom part of a continuous digester. The vast majority of the installed digesters of today have a design similar to FIG. 1. At the bottom of the digester is arranged a bottom scraper comprising a revolving shaft 1 driven by a motor M, and with at least two scraper arms 2*a*,2*b* and a central cone diverter 3 mounted at the revolving shaft. At each arm are also attached scraper blades 4. The bottom of the digester shell is a cupped gable end and the scraper arms are arranged to sweep over the inside of the gable end and push the cooked pulp towards a central outlet 20. Typically, the arms are slightly angled at an angle α in relation to the horizontal plane in the range between 5°-30°. The cone diverter is used to reduce risk of channeling of pulp flow, which channeling could result in that the core pulp flow quicker trough the digester than pulp passing down over the digester wall, and thus ends in uneven pulp quality. As in most digesters is also the bottom of the digester designed to implement a final wash zone. Conventionally, cleaner wash liquid, which could be brown stock washing filtrate, is introduced into the bottom of the digester through several wash dilution nozzles, here vertical nozzles VN and horizontal nozzles HN. A vertical countercurrent flow, as indicated with grey flow arrows, of this wash liquid is established up to a wash screen WS. As a complement to the axial displacement wash is also a radial wash displacement established by adding wash liquid trough a central pipe CP, which outlet mat be located slightly below, or above, the wash screen WS. The wash screen WS is a slotted screen plate or preferably a stave/bar screen which withdraws used wash liquid and collects it in a wash extraction chamber WEC, which in turn is emptied to a wash header WH before being withdrawn from the digester. Typically, the total retention time for the pulp is in this wash zone about 10-30 minutes, but said retention time could be lower as production increases down to 5 minutes, and could be increased as production decreases up to 45 minutes.

U.S. Pat. No. 6,280,575 discloses an idea for improved design of the bottom scraper with the objective to reduce the power requirements. Here is proposed to install a false bottom in the digester with a frusto-conical form, said cone having an angel α between 40-50 degrees to the horizontal line. The alleged reduction in necessary power for a bottom scraper is 10-20%. However, the torque arm length from center of bottom scraper to outer end of scraper arm is the same, and the total chip column surface to be "shaved" by the arms of the bottom scraper is extended as the cone angle increases. Another problem is that the false bottom wall needs to be supported structurally in order to withstand the total pressure inside the digester, or needs to be hydraulically balanced such that the void volume behind the false bottom is filled with liquid at same pressure as in the digester. Another problem with this design is that the pulp passing the wall of the digester ("sheet pulp") meets the bottom scraper sooner than the pulp passing down in the center ("core pulp"), resulting in different retention time in the digester and thus results in uneven pulp quality. Typically, the design chip column speed is about 10 minutes/meter, causing a difference in retention time between sheet and core pulp of about 40 minutes in a digester with a diameter of 8 meter using a bottom scraper with arms inclined 45 degrees.

In FIG. 2 is yet another idea for improved design of the bottom scraper. In this concept are the arms of the scraper bent upwardly at the outer end, such that the outer ends sweeps closer to horizontal dilution nozzles HN. The outer end has a larger deflection angle α2 compared to the arm angel α close to scraper shaft.

A first objective of the present invention is to obtain a reduction in power consumption of the conventional bottom scraper located in the cupped gable end of digester pressure vessel.

Another objective is to reduce the mechanical agitation on delignified pulp such that losses in pulp strength are reduced.

A third objective is to enable this reduction with a potential rebuild in existing digesters, where the rebuild actions are inexpensive in comparison to other alternatives.

The present invention relates to a continuous digester for producing delignified cellulosic material. The digester having:

- An outer digester shell designed for withstanding the pressure applied in the digester,
- A bottom with a central outlet (20) for the delignified cellulosic material, and
- A bottom scraper including scraper arms (2*a*,2*b*) with scraper blades, and a cone diverter (3) driven by a rotating shaft (1), the scraper arms (2*a*,2*b*) are angled at an angle α in relation to the horizontal plane in the range between 5°-30°,
- A wash zone in the digester bottom with nozzles (HN, VN, CP) adding wash or dilution liquid to bottom of digester and a wash screen (WS) located at a distance above the bottom scraper, with no other withdrawal screens between the scraper and the wash screen (WS), for withdrawing at least a part of the added wash or dilution liquid after a displacement trough the delignified cellulosic material, said distance providing for a wash zone having a retention time of 5-45 minutes of the delignified material, A wash extraction chamber (WEC) located behind the wash screen, and between the digester shell and the wash screen, said wash extraction chamber having an radial extension (A) as seen in the radial direction of the digester.

These above features are conventional design features in a continuous digester. However, in order to reduce the power requirements for the bottom scraper and reduce pulp strength losses, as well as enabling an easy rebuild of existing digesters, is the bottom of the digester rebuilt as described as follows.

Below the wash screen (WS) is arranged an vertical extension (VE) of the interior digester wall down towards the end of the outer arm of the bottom scraper, said vertical extension (VE) ending at a distance (D) shorter than 3 times the radial extension (A) of the wash extraction chamber above the outer end of the scraper arms, and with a radial extension (R) between the digester shell (DS) and the inner wall (IW) of the vertical extension of the interior digester wall being in the range of 50-100% of the radial extension (A) of the wash extraction chamber.

In a preferred embodiment using the optimal vertical stave- or bar screens, using a small step-out after the wash screen could the said radial extension (R) between the digester shell (DS) and the inner wall (IW) of the vertical extension (VE) of the interior digester wall be in the range of 70-90% of the radial extension (A) of the wash extraction chamber.

Thus, a small step-out corresponding to at least 10% of the wash extraction chamber could be established, while a larger step-out up to 30% may be established. The inner facing surface of the inner wall (IW) may also be strictly vertical, or slightly inclined in the ranges defined, obtaining a successive and controlled radial expansion of the pulp column downwardly.

In principle, the vertical extension of the interior digester wall is established by a box like design, with an inwardly facing surface IW forming one vertical wall of the box and the existing digester shell DS is the other vertical wall, said box being closed in the upper end by the existing lower face of the wash header (WH) and preferably closed in the lower end by another additional wall finishing the box structure. Thus, only a new vertical wall needs to be installed, and preferably supported in the lower end by an additional horizontal wall member. Even if a closed volume could be formed by the box like design of the vertical extension, also an open volume could be formed as long as the inwardly facing surface IW prevents the pulp column from expanding.

By this design could the pulp column descending down in the digester be prevented from expanding below the final wash screen and take support from the digester wall. The conventional "flat" bottom scraper with modest inclination angles in the range of 5°-30° towards the horizontal could still be used sweeping over the entire bottom part of the digester pressure vessel. The optimal design for pressure vessels using a cupped gable end could thus still be used without any conical inserts which are unfavorable for pulp flow.

The vertical extension thus capable of holding the chip column together until the bottom scraper could shave on the downwardly directed face of the descending plug formed flow of pulp. The bottom scraper, and especially the outer ends of the scraper arms, could thus start to shave on the descending pulp column in a position where the pulp column is subjected to expansion and without any pulp column support from digester shell.

In a preferred embodiment of the continuous digester could the vertical extension end at a distance shorter than twice the radial extension of the wash extraction chamber above the outer arm of the bottom scraper. In absolute distance this could correspond to that the vertical extension ends at a distance shorter than 300 millimeters above the outer arm of the bottom scraper.

In another preferred embodiment of the continuous digester is the vertical extension of the interior digester wall a blank plate. This is the most inexpensive alternative but other alternatives than a blank plate could be used, such as a strainer plate design or a stave/bar screen design, as long as these options are capable of preventing the chip column from expanding.

In yet another preferred embodiment of the continuous digester could the vertical extension of the interior digester wall be arranged at a smaller step-out distance (SO) from the interior surface of the wash screen. This kind of small step-out is conventionally used after all vertically oriented stave/bar screens, I.e. one step-out after each individual screen row, where the step-out is implemented to avoid any blocking of the lowermost open slot of the screen. This step-out distance being preferably in the range 8-20 millimeters, which is fully sufficient for any chip fragments caught between screen bars from being pushed out from the slot.

In a further embodiment of the continuous digester could a wash header be arranged between the wash extraction chamber and the vertical extension of the interior digester wall. The interior wall of the wash header is preferably being located flush with the inwardly facing surface of the vertical extension of the interior digester wall.

In still another embodiment of the continuous digester could also a wash or dilution nozzle be located below the lower end of the vertical extension of the interior digester wall and above the outer end of the scraper arm. By this design could the established void under the extension, said void not being filled with pulp, be used to distribute added wash or dilution liquid evenly around the entire circumference of the digester. The ends of the scraper arms, exposed to the longest torque arm, will then sweep over a highly diluted volume and thus subjected to a reduced torque resistance.

DETAILED DESCRIPTION

Figure 1:
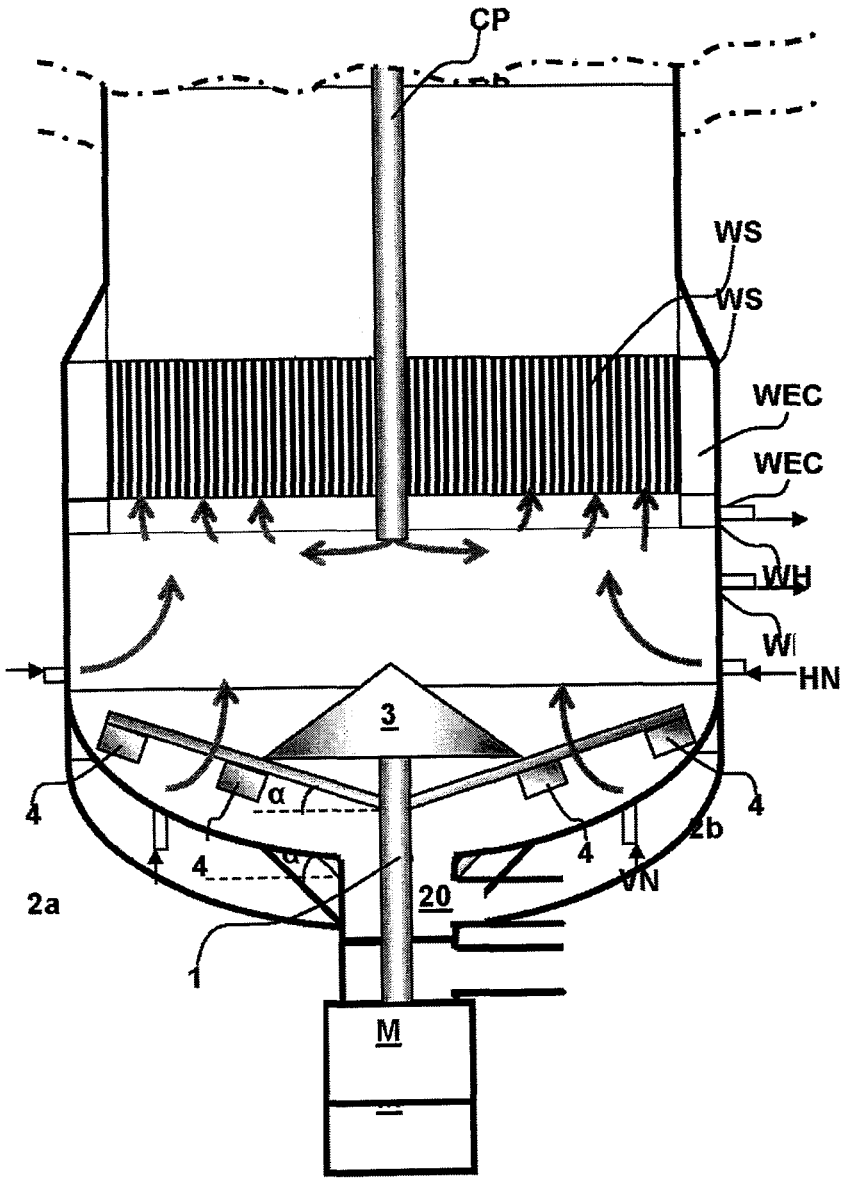
Fig. 1 Prior Art
FIG. 1 discloses a prior art bottom scraper for a continuous digester according to conventional design.
Figure 2:
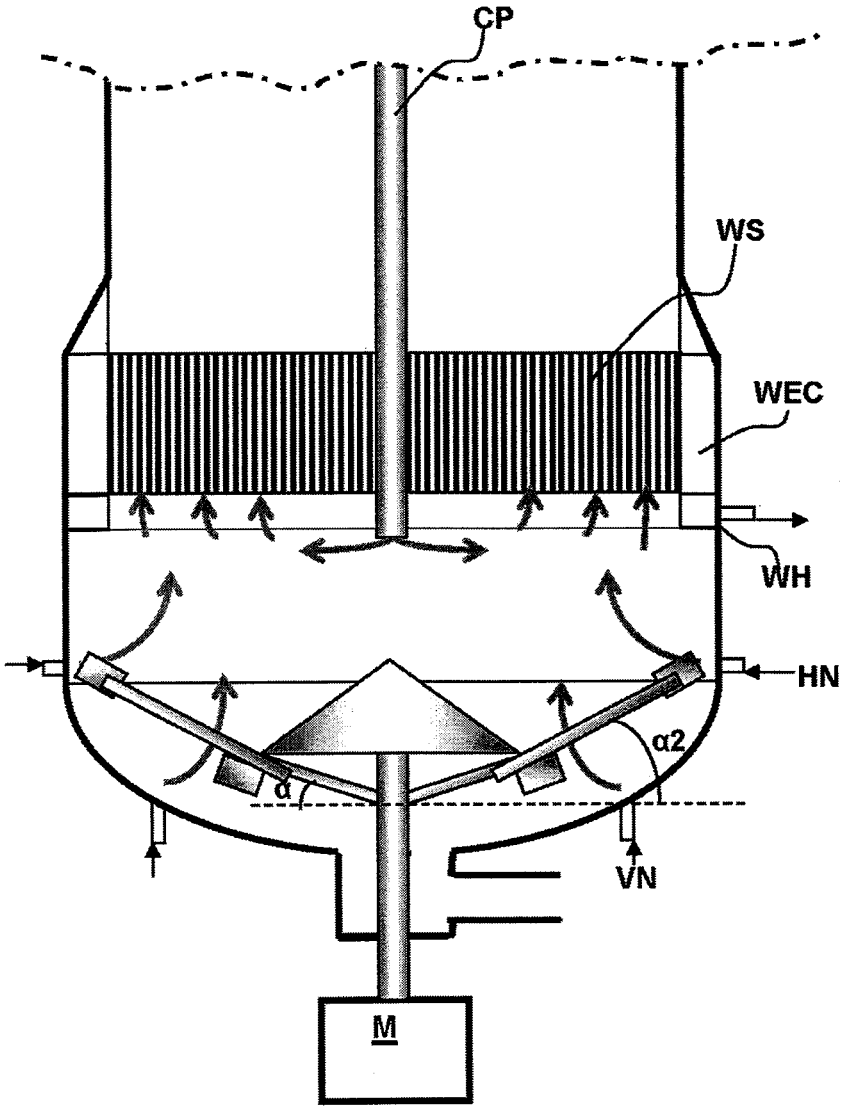
Fig. 2 Prior Art
FIG. 2 discloses yet another alternative prior art design.
Figure 3:
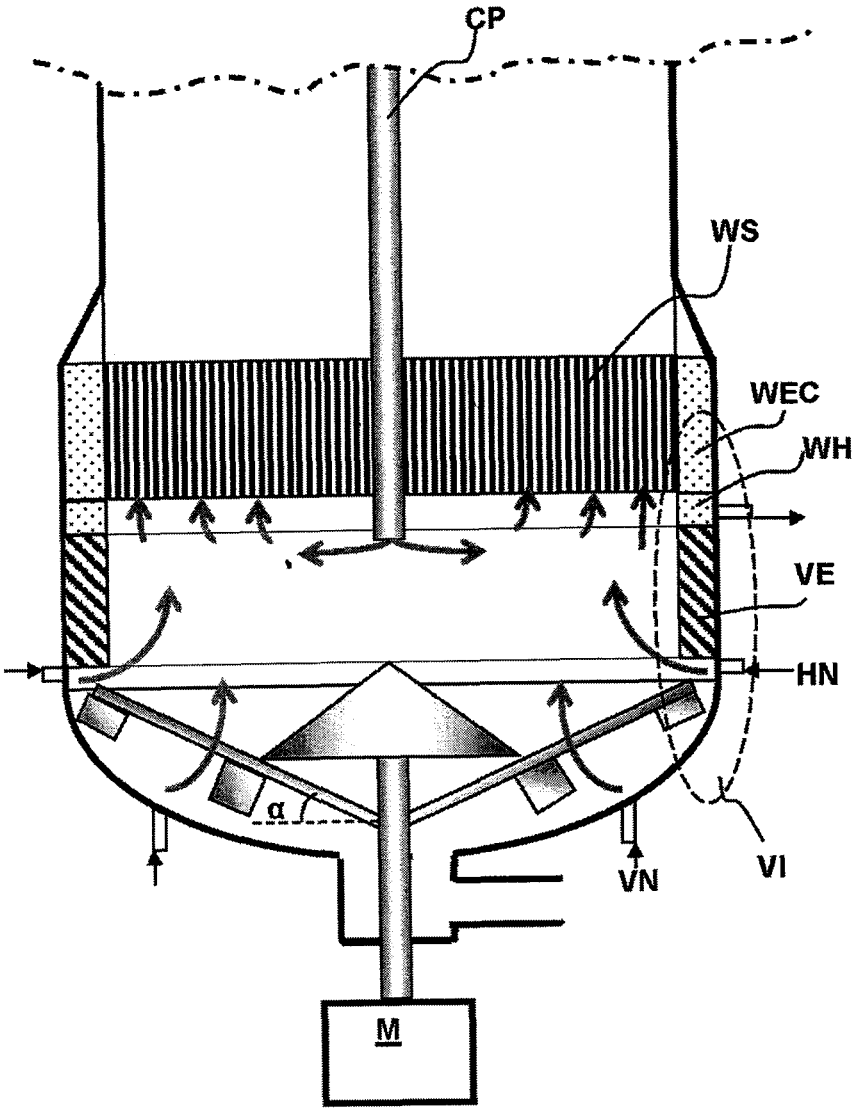
FIG. 3 discloses an embodiment of the present invention.

In FIG. 3 is a first embodiment of the present invention disclosed. The details which are common to the conventional design as disclosed in FIG. 1 are referred to the description of that figure. But what is different in FIG. 3 is that below the wash screen is arranged a vertical extension VE of the interior digester wall down towards the end of the outer arm of the bottom scraper.

Figure 4A:
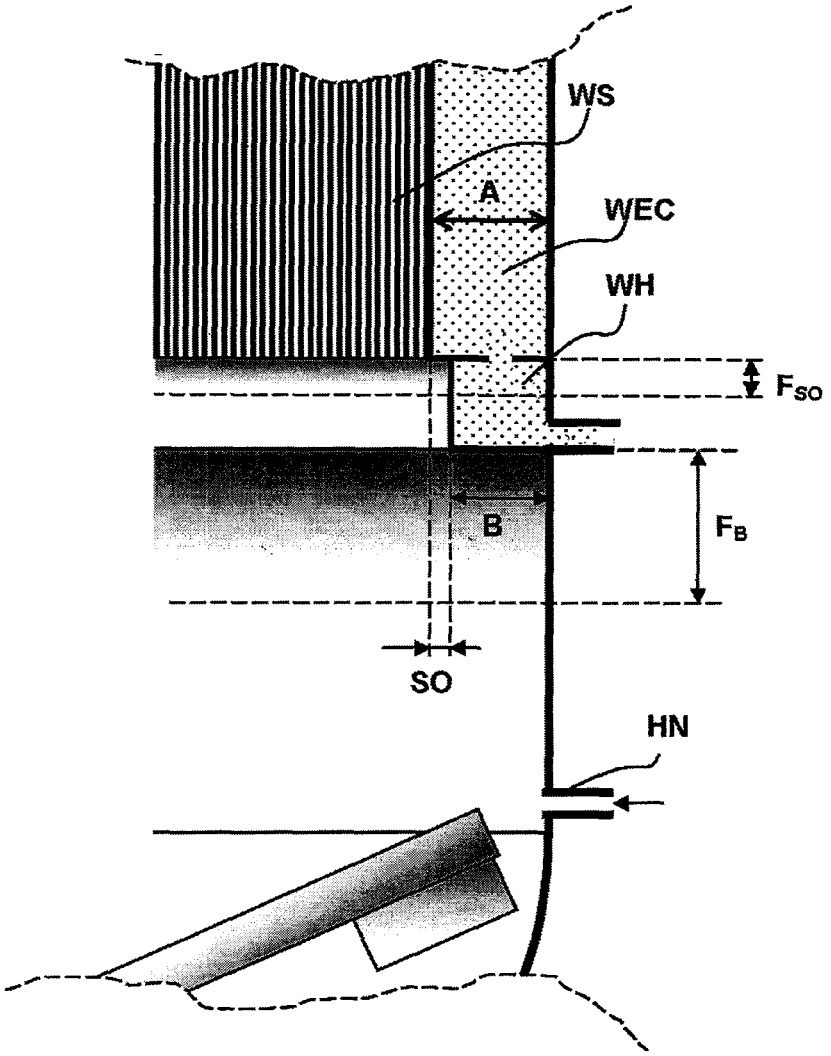
FIG. 4A discloses the typical fouling pattern below step outs in digesters in FIG. 1.

The reason for this design is explained with reference first to FIG. 4A, which disclose an effect from conventional step-outs after a wash screen WS. A wash extraction chamber WEC is located behind the wash screen, and between the digester shell and the wash screen, said wash extraction chamber having a radial extension A as seen in the radial direction of the digester. The wash extraction chamber WEC drains to a lower wash header WH, and the interior wall of the wash header is arranged at a small step-out SO from the interior surface of the wash screen WS. The step-out distance SO is preferably in the range of 8-20 millimeters. Below the wash header WH is a larger step out B obtained which step-out is corresponding to the necessary draining volume needed for the wash extraction chamber, minus the small step-out SO. The step-out B is typically corresponding to the radial distance A of the wash extraction chamber minus the step-out SO. As seen in this figure are fouling areas $F_{SO}/F_B$ indicated with shaded gray areas below the lowermost end of the wash extraction chamber WEC as well as below the lowermost end of the wash header WH. These fouling areas are immediately seen after emptying of digesters during overhaul stops and are a result of the chip column rubbing, or lack of rubbing, against the interior wall of the digester. Directly below a step out is the wall almost black, as the chip column has not rubbed against the wall.

Figure 4B:
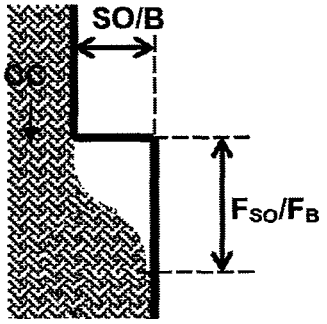
FIG. 4B discloses a step-out portion of a chip column of the present invention.

As seen in FIG. 4B is the chip column expanding below a step out, SO or B, and no rubbing effect is seen directly after the step out, and as an effect will the wall not be rubbed by the pulp column and turn black quickly after a short time of operation. But as the chip column CC expands during its downward flow the rubbing effect increases as the chip column descends downwardly. Below a certain distance is the fouling area $F_{SO}/F_B$ totally exhausted and the digester wall is subjected to full rubbing effect of the descending pulp column, and the digester wall is like a shiny polished metal surface. Hence, after passing the distance $F_{SO}$ or $F_B$ is the pulp column rubbing against the digester wall with full frictional effect, and if a bottom scraper acts at the downwardly face of the descending pulp column, also the frictional forces from the wall must be overcome.

Figure 5:
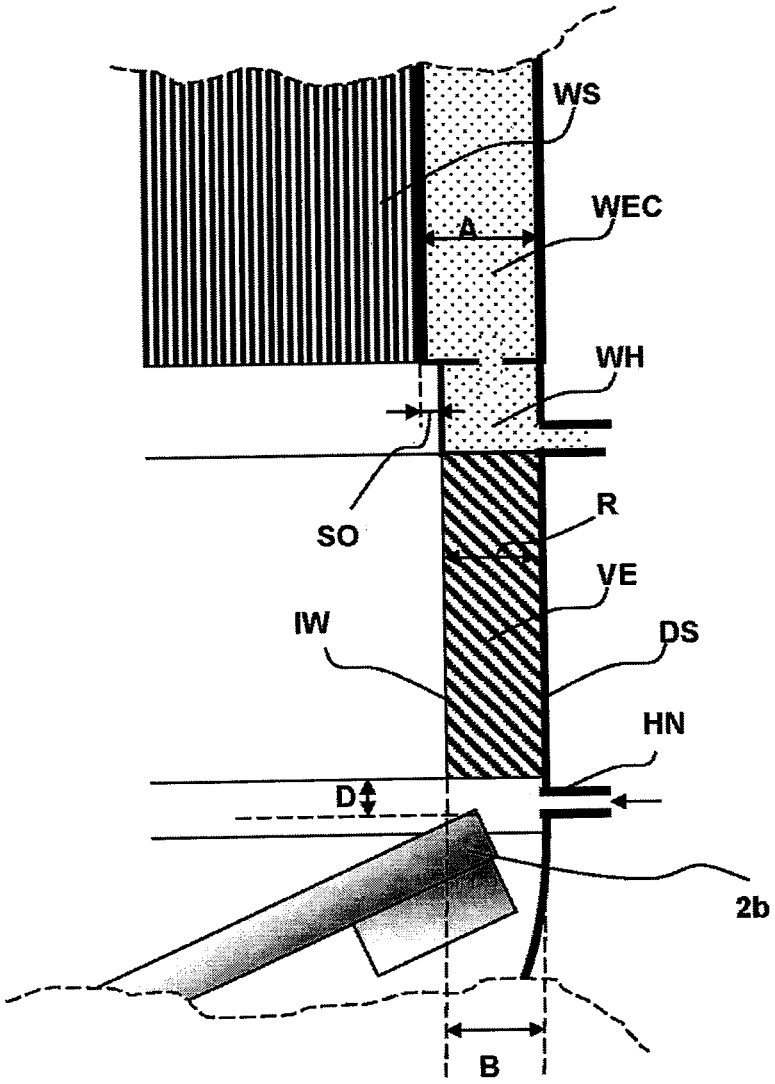
FIG. 5 discloses details of part VI shown in FIG. 3.

In FIG. 5 is the encircled part VI from FIG. 3 described in more detail. Below the wash screen WS is arranged a vertical extension VE of the interior digester wall down towards the end of the outer arm 2*b* of the bottom scraper. Said vertical extension VE ending at a distance D shorter than 3 times the length A above the outer end of the scraper arms, and with a radial extension between the digester shell and the vertical extension of the interior digester wall being equal or less than the length A, which in the figure is the distance B, such that B≤A. In a preferred embodiment said extension could end at a distance D shorter than 2 times the length A above the outer arm of the bottom scraper, and in an absolute measure said extension could end at a distance shorter than 300 millimeters above the outer end of scraper arm of the bottom scraper. In this embodiment is the vertical extension of the interior digester wall a blank plate. Said extension possibly used either as a wash header or supply chamber for wash/dilution liquid. The vertical extension VE of the interior digester wall is preferably arranged at a step-out distance SO from the interior surface of the wash screen WS, said step-out distance being preferably in the range 8-20 millimeters. A wash header WH is also arranged between the wash extraction chamber and the vertical extension VE of the interior digester wall, said interior wall of the wash header may be arranged flush with the vertical extension VE of the interior digester wall. As shown in figure could a wash or dilution nozzle HN be located below the lower end of the vertical extension VE of the interior digester wall and above the outer end of the scraper arm 2*b*. By this design could the torque forces exposed on the scraper arm be reduced, and the scraper arms could have its "shaving" action on a free end of the descending pulp column. As the pulp column is broken up could material be allowed to expand radially into the diluted zone established by the nozzles HN.

The invention enable a simple and cost effective rebuild of the bottom of the digester reducing the torque load on the bottom scraper, while maintaining the original wash zone.

While the present invention has been described in accordance with preferred compositions and embodiments, it is to be understood that certain substitutions and alterations may be made thereto without departing from the spirit and scope of the following claims.

I claim:

1. A continuous digester for producing delignified cellulosic material comprising:

an outer digester shell designed for withstanding the pressure applied in the digester, a bottom with a central outlet for the delignified cellulosic material, and a bottom scraper including scraper arms with scraper blades, and a cone diverter driven by a rotating shaft, the scraper arms are angled at an angle α in relation to the horizontal plane in the range between 5°-30°, a wash zone in the digester bottom with nozzles (HN, VN, CP) adding wash or dilution liquid to bottom of digester and a wash screen (WS) located at a distance above the bottom scraper, with no other withdrawal screens between the scraper and the wash screen (WS), for withdrawing at least a part of the added wash or dilution liquid after a displacement trough the delignified cellulosic material, said distance providing for a wash zone having a retention time of 5-45 minutes of the delignified material, a wash extraction chamber (WEC) located behind the wash screen, and between the digester shell and the wash screen, said wash extraction chamber having an radial extension (A) as seen in the radial direction of the digester, below the wash screen (WS) is arranged an vertical extension (VE) of the interior digester wall down towards the end of the outer arm of the bottom scraper, said vertical extension (VE) ending at a distance (D) shorter than three times the radial extension (A) of the wash extraction chamber above the outer end of the scraper arms, and with a radial extension (R) between the digester shell (DS) and the inner wall (IW) of the vertical extension of the interior digester wall being in the range of 50-100% of the radial extension (A) of the wash extraction chamber.

2. A continuous digester according to claim 1 wherein the radial extension (R) between the digester shell (DS) and the inner wall (IW) of the vertical extension (VE) of the interior digester wall being in the range of 70-90% of the radial extension (A) of the wash extraction chamber.

3. A continuous digester according to claim 1 wherein the vertical extension (VE) ends at a distance (D) shorter than twice the radial extension (A) of the wash extraction chamber above the outer arm of the bottom scraper.

4. A continuous digester according to claim 1 wherein the vertical extension (VE) ends at a distance (D) shorter than 300 millimeters above the outer arm of the bottom scraper.

5. A continuous digester according to claim 1 wherein the inwardly facing surface of the vertical extension (VE) of the interior digester wall is a blank plate.

6. A continuous digester according to claim 5 wherein the vertical extension (VE) of the interior digester wall is arranged at a step-out distance (SO) from the interior surface of the wash screen (WS), said step-out distance being preferably in the range 8-20 millimeters.

7. A continuous digester according to claim 6 wherein a wash header (WH) is arranged between the wash extraction chamber (WEC) and the vertical extension (VE) of the interior digester wall, said interior wall of the wash header (WH) being flush with the inwardly facing surface of the vertical extension (VE) of the interior digester wall.

8. A continuous digester according to claim 7 wherein a wash or dilution nozzle (HN) is located below the lower end of the vertical extension (VE) of the interior digester wall and above the outer end of the scraper arm.

9. A continuous digester according to claim 1 wherein the inwardly facing surface of the vertical extension (VE) of the interior digester wall is a digester screen.

* * * * *